US010729182B2

(12) United States Patent
Chen

(10) Patent No.: US 10,729,182 B2
(45) Date of Patent: Aug. 4, 2020

(54) DUAL AIR FLOW REBUILDABLE DRIPPING ATOMIZER WITH AN ADJUSTABLE AIR FLOW SLEEVE FOR AN ELECTRONIC CIGARETTE

(71) Applicant: APVLAB LLC, Chino, CA (US)

(72) Inventor: Kevin Chen, Diamond Bar, CA (US)

(73) Assignee: APVLAB LLC, Chino, CA (US)

( * ) Notice: Subject to any disclaimer, the term of this patent is extended or adjusted under 35 U.S.C. 154(b) by 166 days.

(21) Appl. No.: 15/802,059

(22) Filed: Nov. 2, 2017

(65) Prior Publication Data

US 2018/0132533 A1 May 17, 2018

Related U.S. Application Data

(60) Provisional application No. 62/416,489, filed on Nov. 2, 2016.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |

(52) U.S. Cl.

CPC ..... *A24F 47/008* (2013.01)

(58) Field of Classification Search

CPC ..... A24F 47/008; A24F 47/002; A24F 47/004
USPC ..... 131/329, 330, 328
See application file for complete search history.

(56) References Cited

U.S. PATENT DOCUMENTS

| | | | | |
|---|---|---|---|---|
| 6,345,625 | B1 * | 2/2002 | Chew | A24D 3/04 131/187 |
| 8,528,569 | B1 * | 9/2013 | Newton | A61M 15/06 128/202.21 |
| 8,689,805 | B2 * | 4/2014 | Hon | A61M 15/06 131/273 |
| 9,854,848 | B1 * | 1/2018 | Servutas | A24F 47/008 |
| 10,561,176 | B2 * | 2/2020 | Conley | H05B 3/44 |
| 2004/0221857 | A1 * | 11/2004 | Dominguez | A24F 13/04 131/273 |
| 2006/0107965 | A1 * | 5/2006 | Marshall | A24F 47/006 131/330 |
| 2016/0192707 | A1 * | 7/2016 | Li | H05B 3/00 131/329 |
| 2018/0020733 | A1 * | 1/2018 | Jochnowitz | H05B 3/44 131/329 |
| 2018/0077968 | A1 * | 3/2018 | Qiu | F22B 1/284 |

(Continued)

*Primary Examiner* — Abdullah A Riyami
*Assistant Examiner* — Thang H Nguyen
(74) *Attorney, Agent, or Firm* — Loza & Loza, LLP; Heidi L. Eisenhut

(57) ABSTRACT

A dual air flow rebuildable dripping atomizer for use with electronic cigarettes which uses a sleeve lock that allows the user to adjust and direct the air flow is provided. The adjustable air flow sleeve also allows the sleeve to be locked in place preventing the e-liquid from leaking out. Rotating the adjustable air flow sleeve in a clockwise or counter-clockwise direction allows not only the direction of the air flow to be determined but how much air enters an inner air chamber of the atomizer. As a result, a user can determine, for example, the size of the vapor cloud and the intensity of the flavor. Additionally, the adjustable air flow sleeve may be adjusted to block air holes located on an inner edge surface of the adjustable air flow sleeve preventing the e-liquid from leaking.

17 Claims, 10 Drawing Sheets

(56) References Cited

U.S. PATENT DOCUMENTS

2019/0142071 A1* 5/2019 Seok ..... A24B 15/167
131/329
2019/0380387 A1* 12/2019 Rose ..... H05B 3/04

* cited by examiner

DUAL AIR FLOW REBUILDABLE DRIPPING ATOMIZER WITH AN ADJUSTABLE AIR FLOW SLEEVE FOR AN ELECTRONIC CIGARETTE

CROSS REFERENCE TO RELATED APPLICATIONS

This application claims priority to a provisional application, U.S. Ser. No. 62/416,489, filed Nov. 2, 2016, entitled "Rebuildable Dripping Atomizer for an Electronic Cigarette".

FIELD

The present invention relates to electronic cigarettes and in particular to a rebuildable dripping atomizer with adjustable air flow for use with an electronic cigarette.

BACKGROUND

An electronic cigarette, or e-cigarette, is a handheld, battery operated device that is designed to turn nicotine and other chemicals into a vapor which is delivered to the lungs via inhalation. The primary components of an electronic cigarette parts are a mouthpiece, a tank (or cartridge), a heating element/atomizer, and a battery. The atomizer comprises a small heating element, or coil, that vaporizes liquid solution or e-liquid and wicking material, such as cotton, that draws e-liquid onto the coil, when air flows through the atomizer. When the user activates the electronic cigarette, for example by pushing a button, activating a pressure sensor by inhaling, or any other known method in the art, the heating element in the atomizer atomizes the liquid solution creating a vapor which the user inhales. The vapor provides a flavor and feel similar to tobacco smoking.

With the increasing popularity of electronic cigarettes comes various competitions among electronic cigarette smokers, such as competitive vaping (or "cloud chasing") in which competitors try to blow the biggest, densest vapor cloud possible. Users utilize the air flow in the atomizer to draw the vapor from where it's being created and into the mouth/lungs of the user, to change the vapor cloud. When a large about of air flow is passing through the coils, the vapor gets less dense but produces larger vapor clouds. While this allows for a bigger vapor cloud, it also reduces the flavor. Conversely, users who are more concerned with the flavor and less with the size of the vapor cloud, may desire to limit the air flow.

While there are existing atomizer on the market that allow users to adjust the air flow, these prior art atomizers utilize caps that cover the tank where the e-liquid is stored. However, these caps can be easily pulled off or loosened. When the cap is pulled off or loosened, the e-liquid can then leak out of the tank. This can be very problematic for users who carry their electronic cigarettes in their pockets, bags, purses, etc.

In view of the above, what is needed is a rebuildable dripping atomizer which uses a sleeve lock that allows the user to adjust and direct the air flow while preventing the e-liquid from leaking out of the atomizer.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a rebuildable dripping atomizer for an electronic cigarette is provided. The rebuildable dripping atomizer includes an inner air chamber, the inner air chamber, an adjustable air flow sleeve mounted over the inner air chamber a removable cap adapted to be received on the adjustable air flow sleeve; and a removable mouthpiece secured to the removable cap. The inner air chamber may include a building deck portion having one or more dynamic bottom air flow channels; and an inner sleeve portion mounted onto the building deck portion, the inner sleeve portion having at least two concave grooves extending a vertical length of the inner sleeve portion where at least one of the at least two concave grooves include a side air flow channel forming a passageway allowing air flow to be diverted. The adjustable air flow sleeve may include an outer surface; and an opposing inner surface, the inner surface having one or more protrusions integrally connected to and extending outwardly therefrom, the one or more protrusions moveable within the passageway.

According to one aspect, the removable cap include a plurality of cut out portions on a side edge forming openings in the atomizer when the removable cap is secured to the adjustable air flow sleeve.

According to another aspect, the rebuildable dripping atomizer may further include an inner edge surface extending outwardly from the inner surface, the inner edge surface having one or more inner edge surface holes configured to allow air into the inner air chamber from outside the atomizer.

According to yet another aspect, the inner edge surface has a circular configuration and the one or more inner edge surface holes are equally spaced around the inner edge surface.

According to yet another aspect, the inner sleeve portion of the inner air chamber extends outwardly from the inner edge surface.

According to yet another aspect, each of the one or more protrusions may include a top wall member extending in a first vertical plane; a bottom wall member extending in a second vertical plane, where the first vertical plane is different than the second vertical plane; an edge wall member integrally connecting the top wall member and the bottom wall member; a first side wall member extending downwardly in a concave manner from a first side end of the edge wall member to first outer edges of the top and bottom wall members; and a second side wall member extending downwardly in a concave manner from a second side end of the edge wall member to second outer edges of the top and bottom wall members.

According to yet another aspect, the adjustable air flow sleeve is rotatable in a clockwise direction locking the adjustable air flow sleeve to the building deck portion of the inner air chamber and locking the protrusions in the passageway securing the inner sleeve portion to the building deck portion.

According to yet another aspect, the adjustable air flow sleeve is rotatable in the clockwise direction 60 degrees.

According to yet another aspect, the side air flow channel on the inner sleeve portion of the inner air chamber are being used and dynamic bottom air flow channels on the building deck portion of the inner are chamber are sealed off.

According to yet another aspect, the adjustable air flow sleeve rotates in a counter-clockwise direction locking the adjustable air flow sleeve to the building deck portion of the inner air chamber and locking the protrusions in the passageway securing the inner sleeve portion to the building deck portion.

According to yet another aspect, the adjustable air flow sleeve is rotatable in the counter-clockwise direction 60 degrees.

According to yet another aspect, the adjustable air flow sleeve rotates independently of the inner air chamber.

According to yet another aspect, rotating the adjustable air flow sleeve around the inner sleeve portion of the inner air chamber causes the one or more inner edge surface holes on the inner edge surface of the adjustable air flow sleeve to open and close allowing and preventing air from entering the atomizer.

According to yet another aspect, the side air flow channel on the inner sleeve portion of the inner air chamber have an elongated configuration located in a vertical plane.

According to yet another aspect, the dynamic bottom air flow channels on the building deck portion of the inner air chamber have an elongated configuration located in a vertical plane.

According to yet another aspect, the mouthpiece may include an upper end portion; a lower end portion configured to be received within an opening of the removable cap, the lower end portion having a plurality of spit back openings located around a bottom side surface of the lower end portion; and a middle stop portion integrally connected between the upper end portion and the lower end portion.

According to yet another aspect, the detachable mouthpiece has a circular configuration wherein a diameter of the middle stop portion is larger than a diameter of the opening in the cap.

According to yet another aspect, the upper end portion includes an upper lip having a diameter equal to the diameter of the middle stop portion; and wherein an outer surface of the mouthpiece between the upper lip and the middle stop portion has a diameter smaller than the diameter of the upper lip and the diameter of the middle stop portion.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

The following detailed description is of the best currently contemplated modes of carrying out the invention. The description is not to be taken in a limiting sense, but is made merely for the purpose of illustrating the general principles of the invention.

A user of an e-Cig may also be referred to as a vapor and the act of "smoking" may be referred to as vaping. One method used for vaping is "dripping". When dripping, the user removes the cartridge from the atomizer and puts 3-5 drops, for example, of a favorite juice directly onto the atomizer coil or bridge yielding clean puffs full of vapor. Whenever the user wants to take another hit, more drops may be placed on the atomizer.

Overview

Embodiments of the present disclosure are directed to a dual air flow rebuildable dripping atomizer for use with electronic cigarettes which uses an adjustable air flow sleeve rotatable around an inner air chamber to adjust and divert air flow. The adjustable air flow sleeve also allows the sleeve to be locked in place preventing the e-liquid from leaking out. Rotating the adjustable air flow sleeve in a clockwise or counter-clockwise direction allows not only the direction of the air flow to be determined but how much air enters an inner air chamber of the atomizer by opening and/or closing side air flow channels and dynamical bottom air flow channels in the inner air chamber. As a result, a user can determine, for example, the size of the vapor cloud and the intensity of the flavor. Additionally, the adjustable air flow sleeve may be adjusted to block air holes located on an inner edge surface of the adjustable air flow sleeve preventing the e-liquid from leaking.

Figure 1:
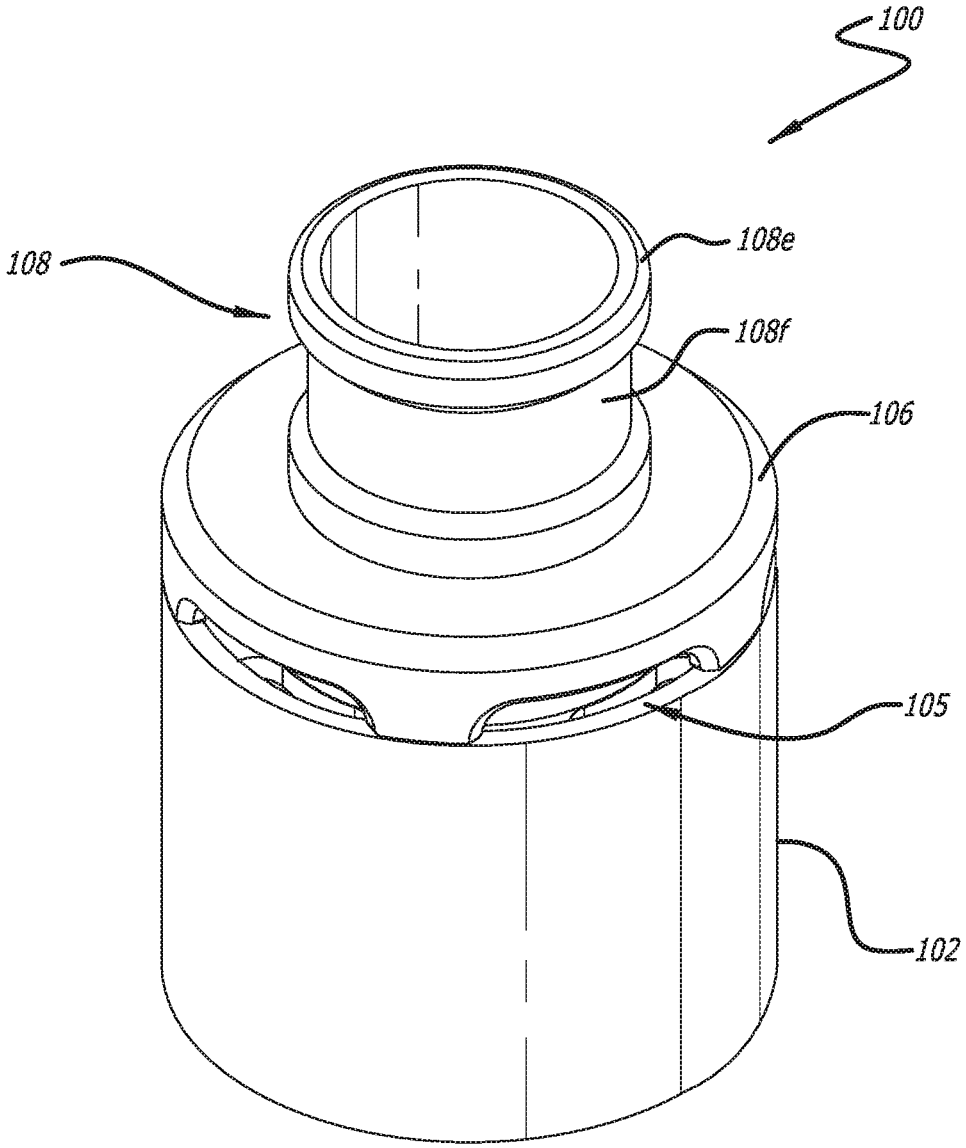
FIG. 1 is a perspective view of a rebuildable dripping atomizer according to the present invention.
Figure 2A:
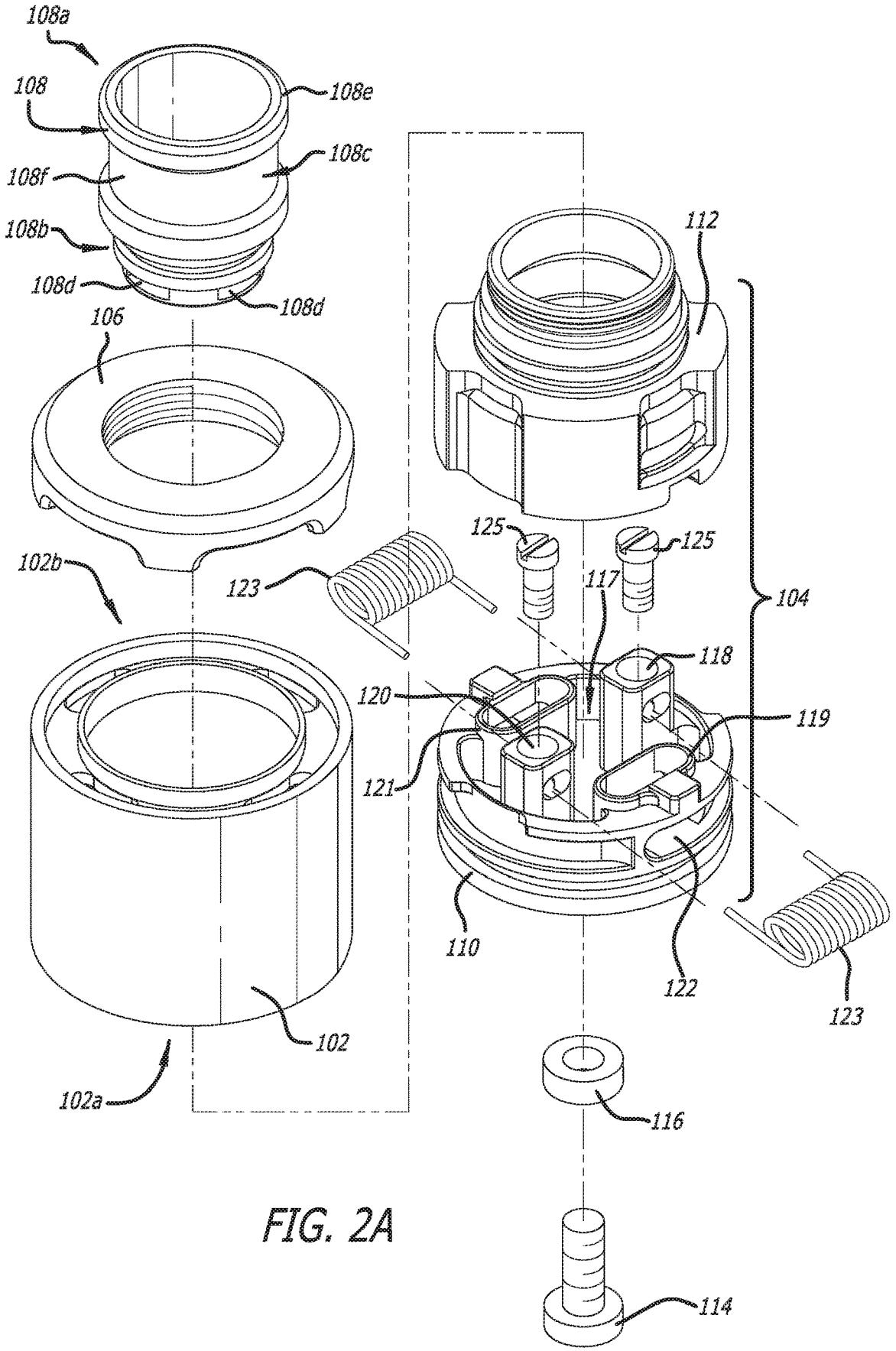
FIG. 2A is an exploded view of the rebuildable dripping atomizer of FIG. 1.
Figure 2B:
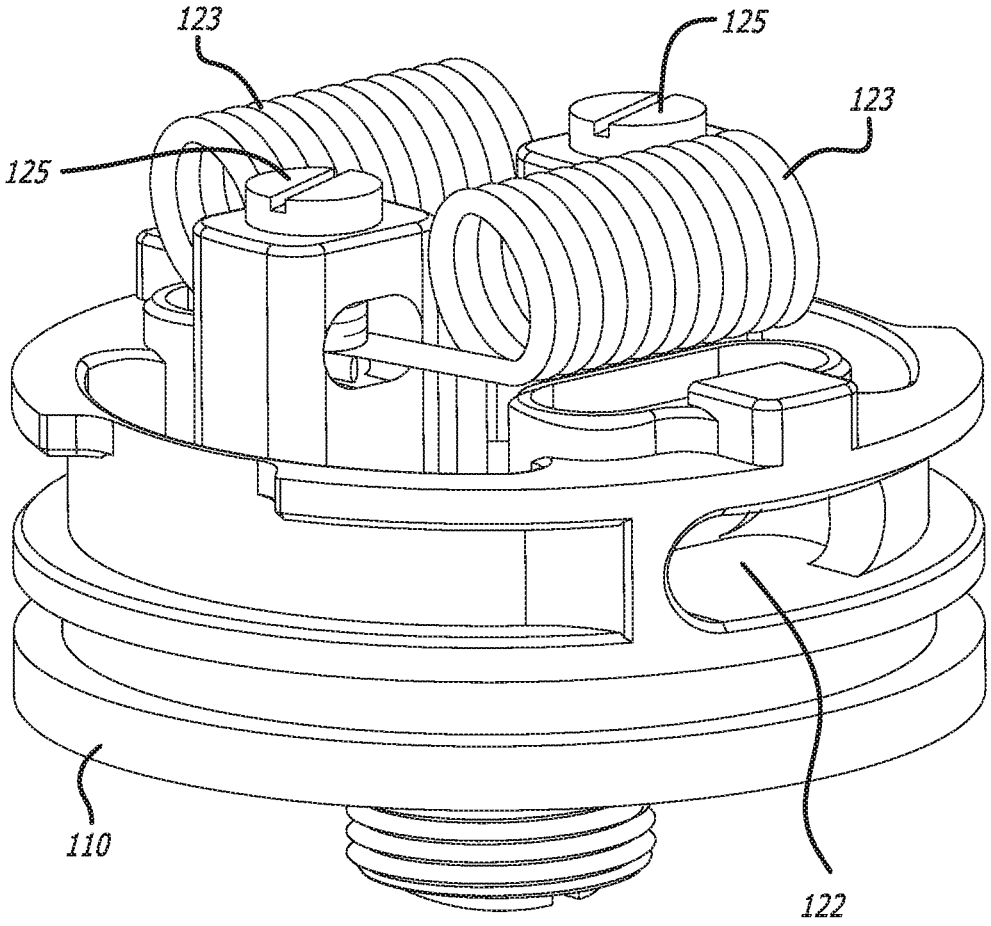
FIG. 2B illustrates a building deck portion of the rebuildable dripping atomizer of FIG. 1.
Figure 3:
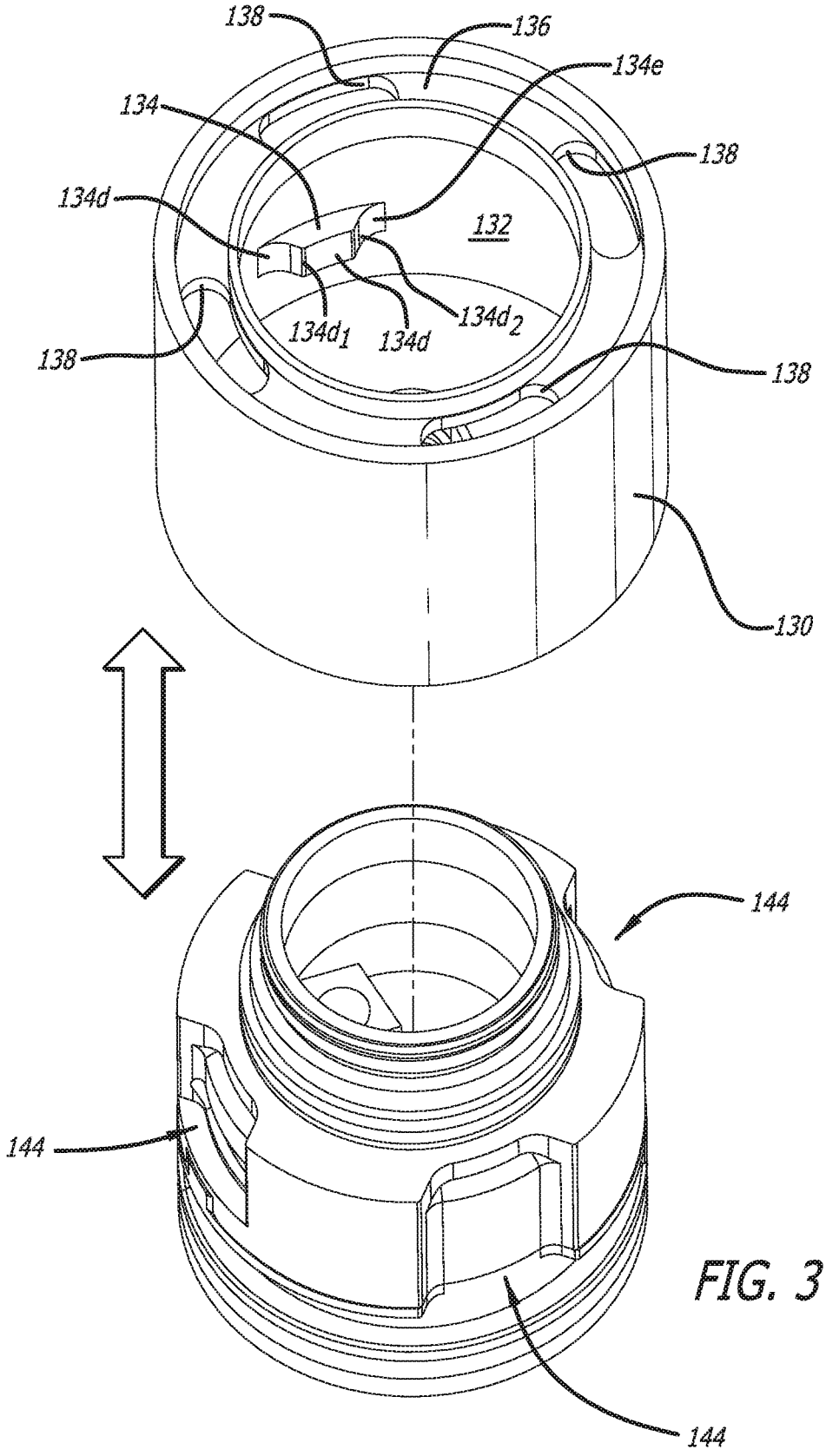
FIG. 3 illustrates an inner air chamber and adjustable air flow sleeve utilized in the rebuildable dripping atomizer of FIG. 1.
Figure 4:
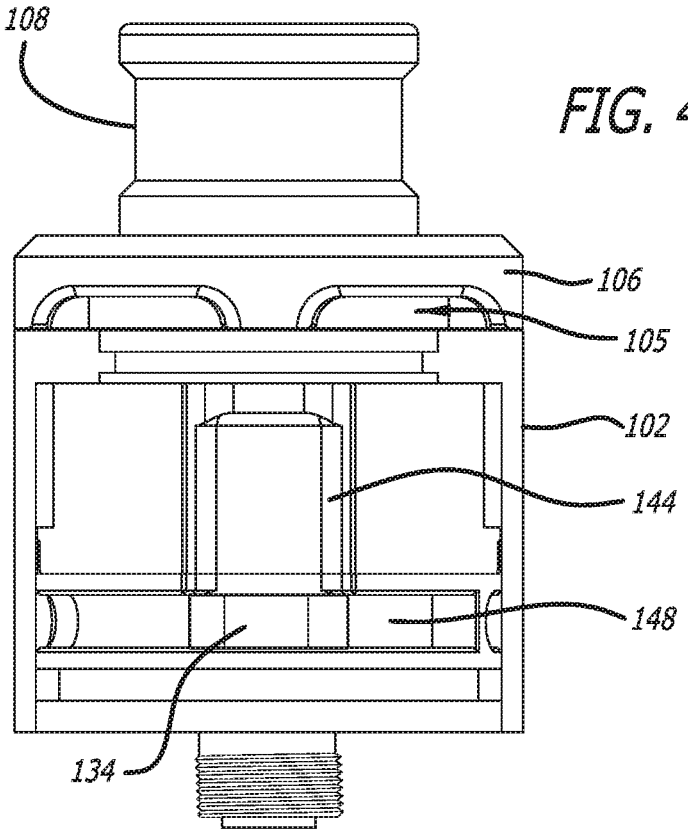
FIG. 4 illustrates a cross-sectional view of the atomizer of the rebuildable dripping atomizer of FIG. 1.
Figure 5:
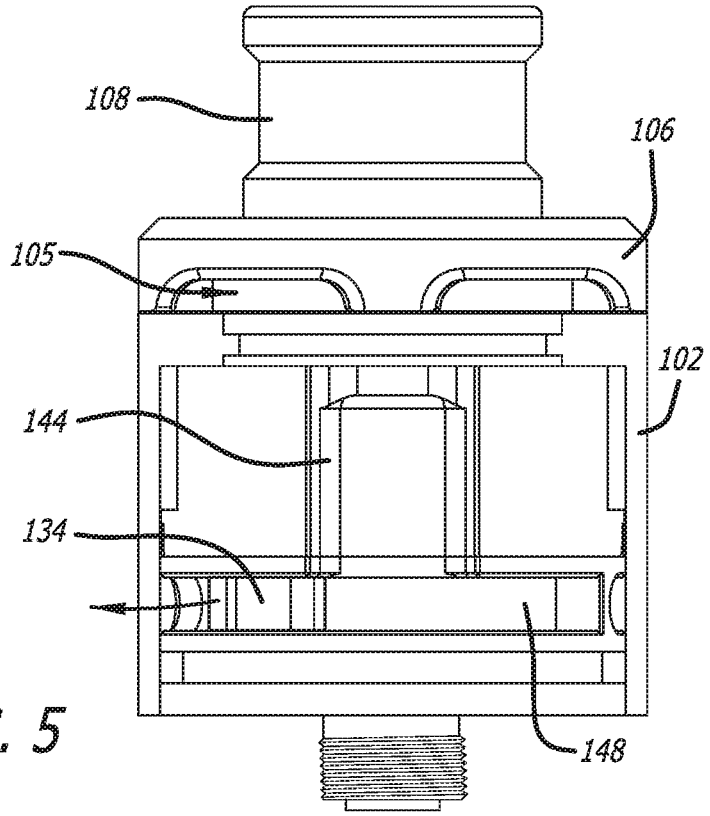
FIG. 5 illustrates a cross-sectional view of the atomizer of the rebuildable dripping atomizer of FIG. 1 with the adjustable air flow rotated 60 degrees clockwise.
Figure 6:
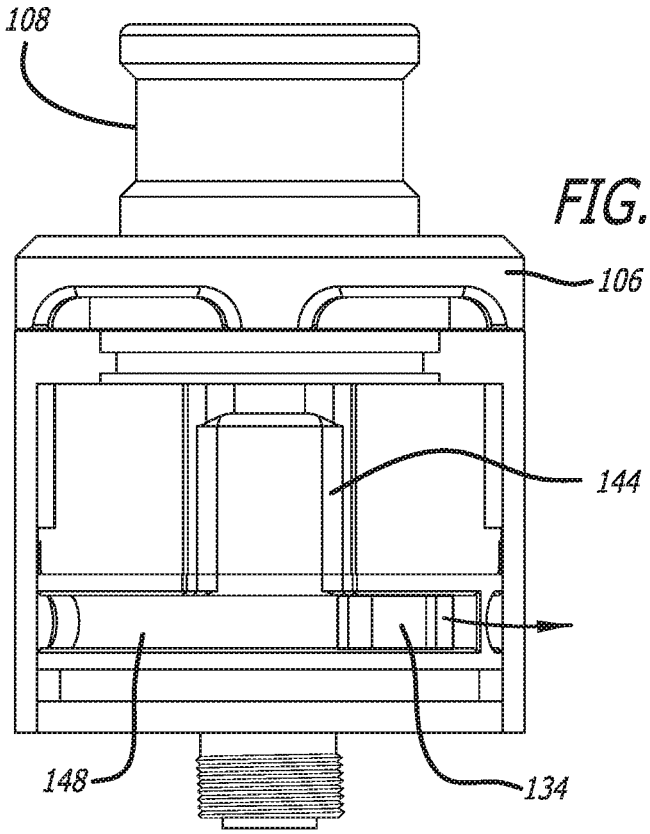
FIG. 6 illustrates a cross-sectional view of the atomizer of the rebuildable dripping atomizer of FIG. 1 with the adjustable air flow sleeve rotated 60 degrees counter-clockwise.
Figure 7:
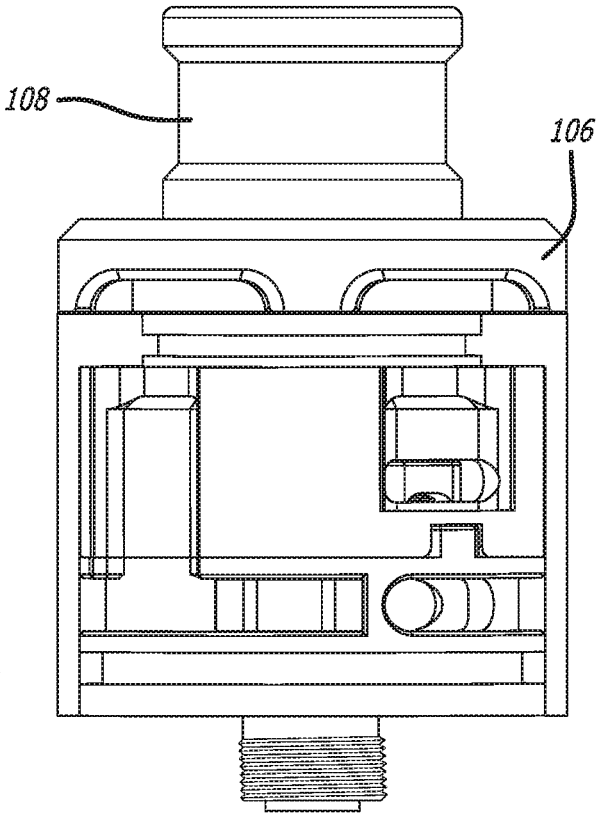
FIG. 7 illustrates a cross-sectional view of the atomizer of the rebuildable dripping atomizer of FIG. 1 with the adjustable air flow sleeve rotated into a closed position.

FIG. 1 is a perspective view of a rebuildable dripping atomizer according to the present invention. FIG. 2A is an exploded view of the rebuildable dripping atomizer of FIG. 1. FIG. 2B illustrates a building deck portion of the rebuildable dripping atomizer of FIG. 1. FIG. 3 illustrates an inner air chamber and adjustable air flow sleeve utilized in the rebuildable dripping atomizer of FIG. 1. FIG. 4 illustrates a cross-sectional view of the atomizer of the rebuildable dripping atomizer of FIG. 1. FIG. 5 illustrates a cross-sectional view of the atomizer of the rebuildable dripping atomizer of FIG. 1 with the adjustable air flow rotated 60 degrees clockwise. FIG. 6 illustrates a cross-sectional view of the atomizer of the rebuildable dripping atomizer of FIG. 1 with the adjustable air flow sleeve rotated 60 degrees counter-clockwise. FIG. 7 illustrates a cross-sectional view of the atomizer of the rebuildable dripping atomizer of FIG.

Figure 8:
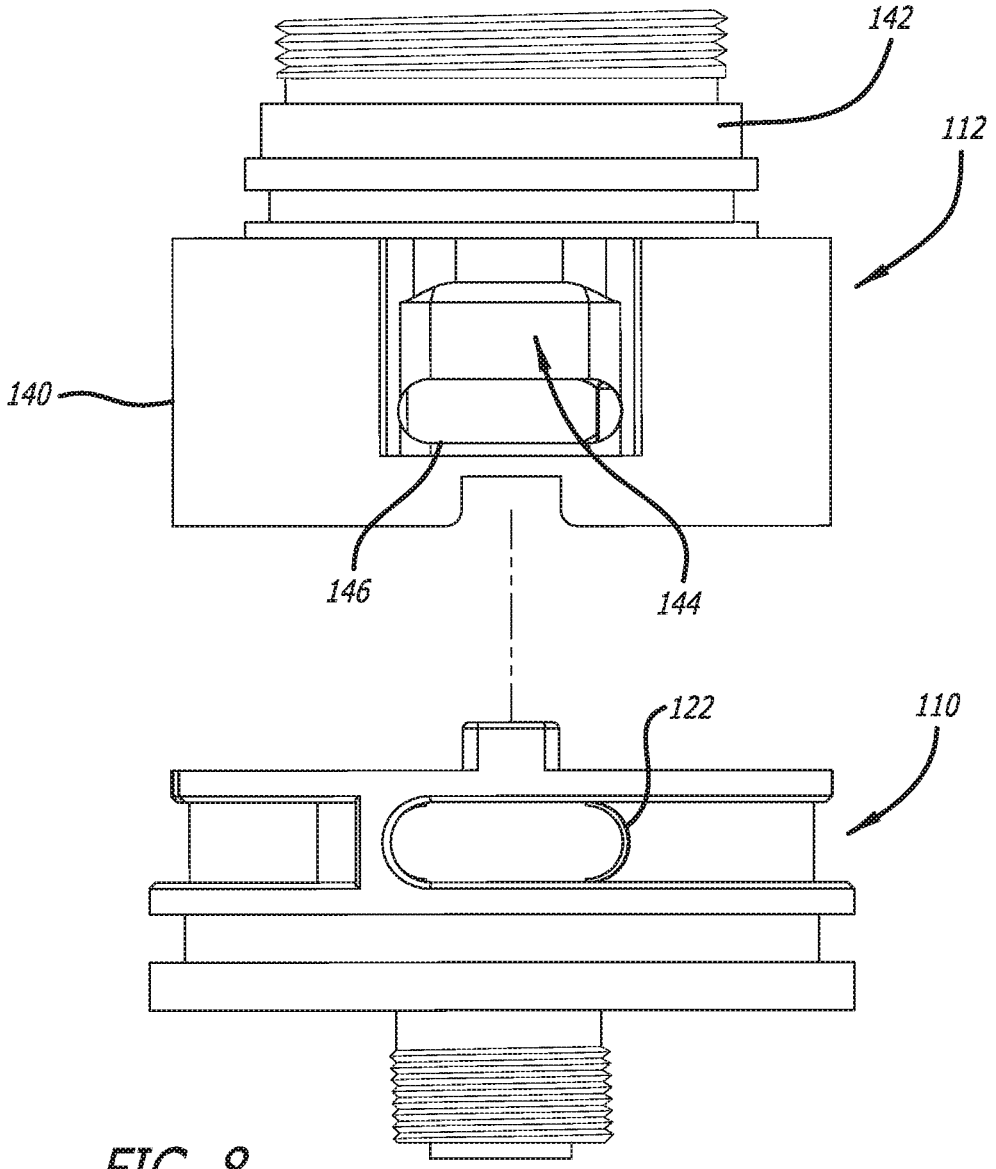
FIG. 8 illustrates an exploded view of the inner air chamber of the rebuildable dripping atomizer of FIG. 1.
Figure 9:
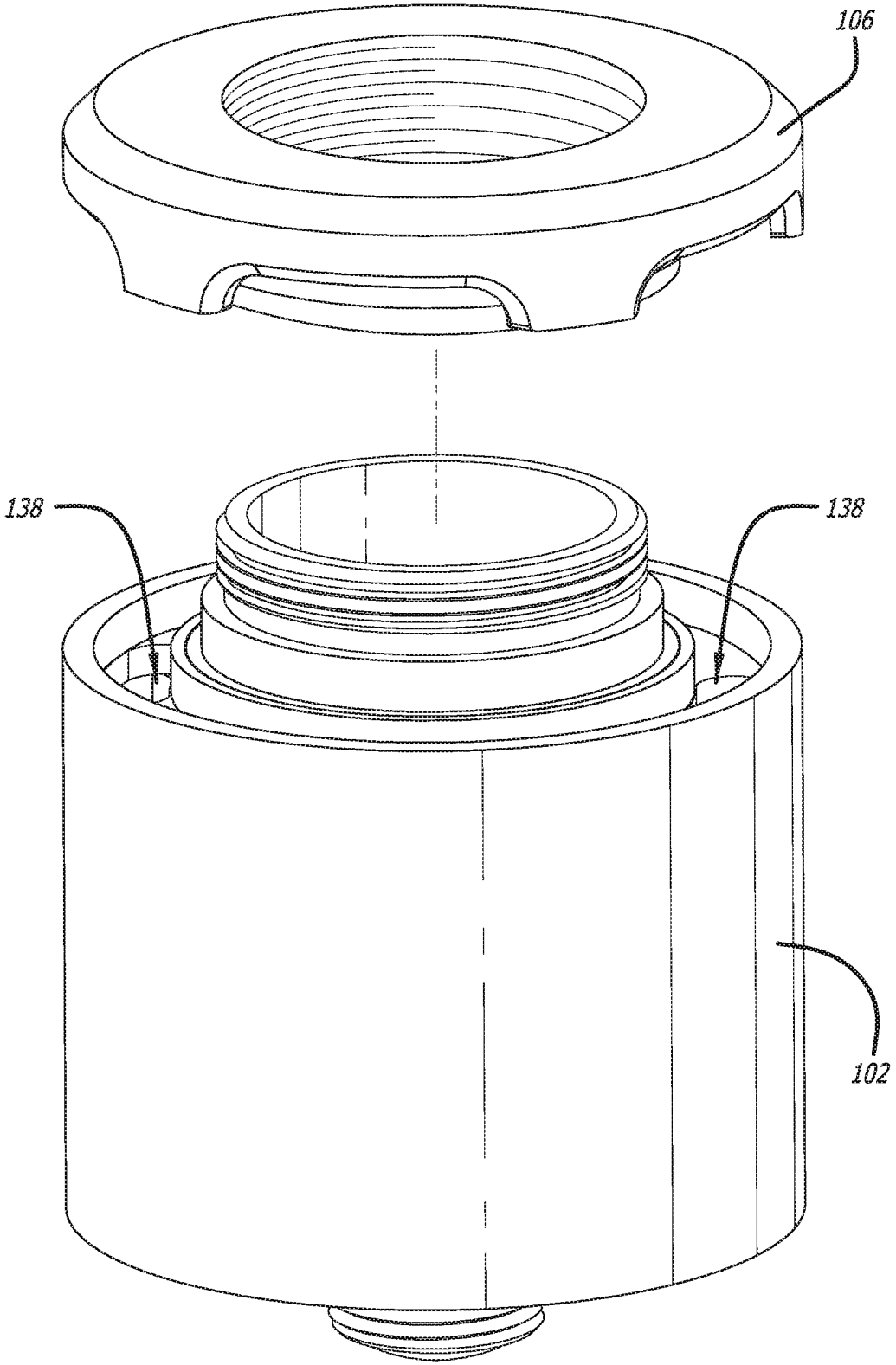
FIG. 9 illustrates the rebuildable dripping atomizer of FIG. 1 with the cap removed from the adjustable air flow sleeve.
Figure 10:
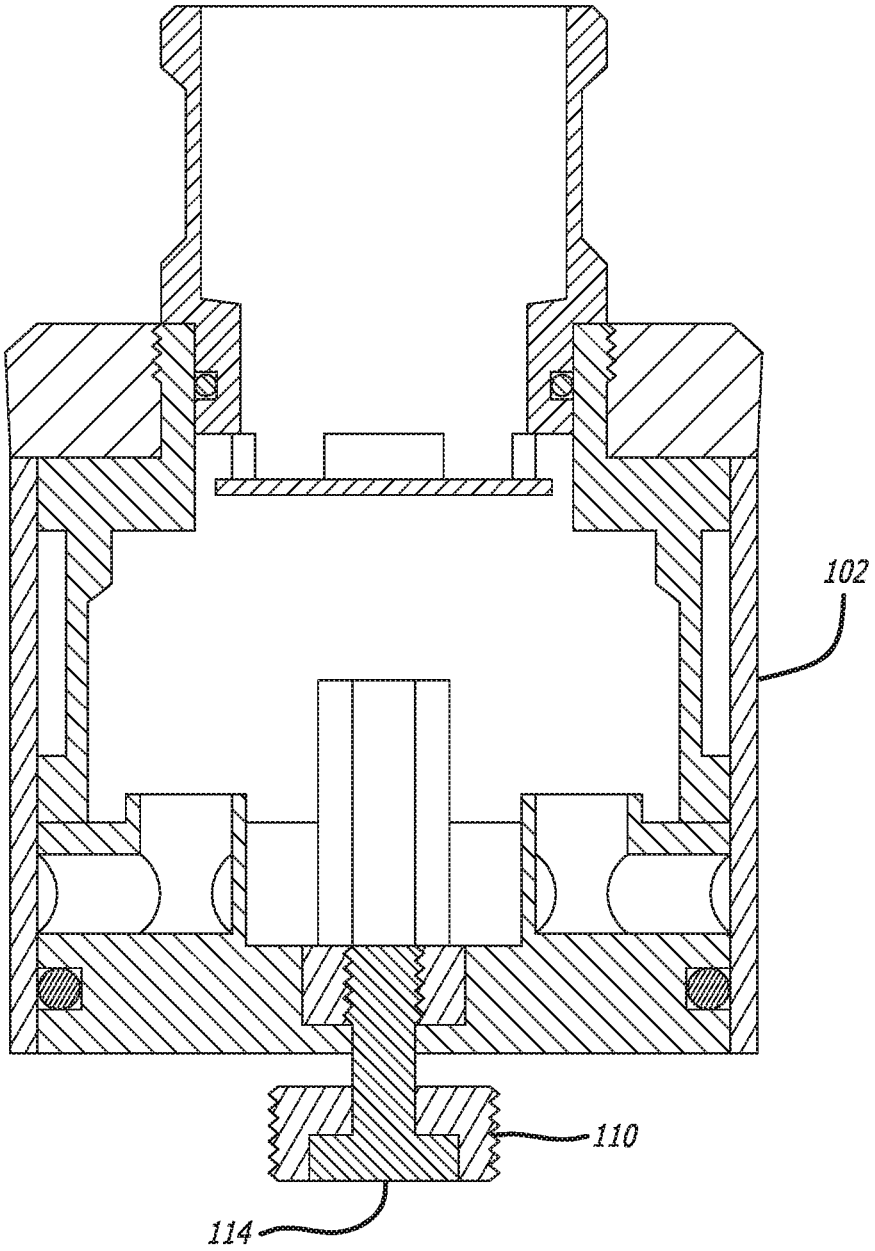
FIG. 10 illustrates a cross-sectional view of the rebuildable dripping atomizer of FIG. 1.

1 with the adjustable air flow sleeve rotated into a closed position. FIG. 8 illustrates an exploded view of the inner air chamber of the rebuildable dripping atomizer of FIG. 1. FIG. 9 illustrates the rebuildable dripping atomizer of FIG. 1 with the cap removed from the adjustable air flow sleeve. FIG. 10 illustrates a cross-sectional view of the rebuildable dripping atomizer of FIG. 1. FIGS. 11A-11D illustrate an interchangeable building deck. The following discussion refers interchangeably to FIGS. 1-11D.

As shown, the rebuildable dripping atomizer 100 may include an adjustable air flow sleeve 102 having a first end 102*a* and an opposing second end 102*b*. An inner air chamber 104 may be mounted within the first end 102*a* of the adjustable air flow sleeve 102 and a removable top cap 106 may be detachably mounted onto the second end 102*b* of the adjustable air flow sleeve 102 for securing the adjustable air flow sleeve 102 to the inner air chamber 104. The removable top cap 106 may have a generally circular configuration and include a plurality of cut out portions 105 located around a side edge portion of the rotatable top cap 106. When the top cap 106 is secured to the second end 102*b* of the adjustable air flow sleeve 102, the plurality of cut out portions 105 form openings allowing air to pass through and into the cap 106. A detachable mouthpiece 108 may be removably mounted to the removable top cap 106. The user can easily add e-liquid to the atomizer by removing the mouthpiece 108

According to one aspect, the detachable mouthpiece 108 has an upper end portion 108*a* and a lower end portion 108*b* where the lower end portion 108*b* is adapted to be received within an opening of the removable cap 106. As shown in FIG. 2A, the lower end portion 108*b* is separated from the upper end portion 108*b* by a middle stop portion 108*c*. The detachable mouthpiece 108 has a generally circular configuration and the diameter of the middle stop portion 108*c* is larger than the diameter of the opening in the cap 106 so that when the mouthpiece 108 is inserted into the opening in the cap 106, the middle stop portion 108*c* rests on top of the cap 106 with the upper end portion 108*a* extending outwardly from the cap 106 and configured for a user to place his or her lips around and inhale. When the user places his or her lips around the mouthpiece 108, the middle stop portion 108*c* resting on top of the cap prevents the lips of the user from touching the top of the cap 106 which is generally made from stainless steel which gets hot during use.

One of the common problems users of electronic cigarettes have is spit back of the e-liquid, i.e. the e-liquid spits out from the e-cigarette into the mouth of a user. As the e-liquid is heated inside the electronic cigarette, the e-liquid is hot and may burn the lips and/or mouth of the user. To prevent spit back, the mouthpiece 108 of the present invention includes a plurality of spit back openings 108*d* located around a bottom side surface of the lower end portion 108*b*. According to one aspect, the plurality of spit back openings 108*d* may be equally spaced around the bottom side surface. When e-liquid flows or spits out of the atomizer it enters the plurality of spit back openings 108*d* and remains at the bottom of the mouthpiece 108 and/or flows back into the atomizer away from the lips and/or mouth of the user.

According to one aspect, a top edge of the upper end portion 108*b* has an upper lip 108*e* which has a circular configuration and has a diameter equal to the diameter of the middle stop portion 180*c*. As shown in FIG. 2A, the outer surface 108*f* of the mouthpiece 108 between the upper lip 108*e* and the middle stop portion 108*c* has a smaller diameter allowing the lips and/or mouth of the user to easily grasp the mouthpiece 108.

The inner air chamber 104 may comprise a building deck portion 110 and an inner sleeve portion 112 (See FIGS. 2A, 2B and 8), where the inner sleeve portion 112 may be placed onto the building deck portion 110. As the atomizer is rebuildable and the components (i.e. the adjustable air flow sleeve 102, the inner air chamber 104, the cap 106 and the mouthpiece 108) can be separated, the user may change out the building deck as desired. The building deck portion 110 of the inner air chamber 104 may include the building deck of the atomizer.

Figure 11D:
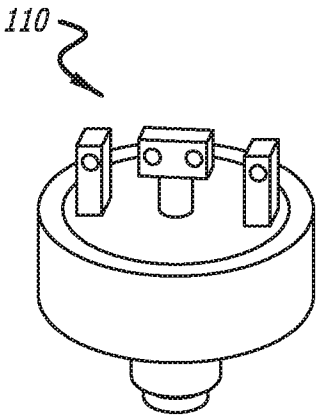
FIG. 11D illustrates a Y post building deck.
Figure 11C:
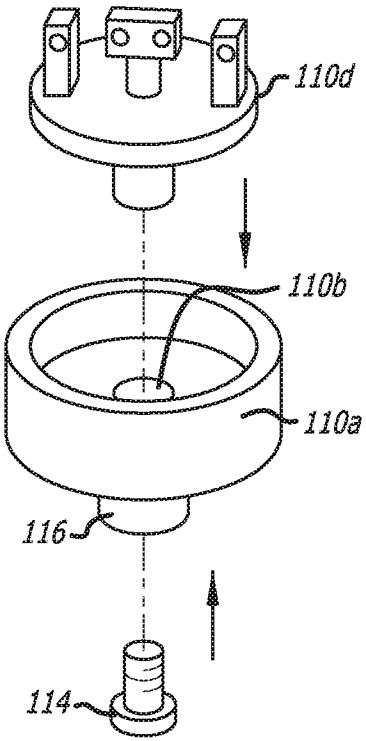
FIG. 11C illustrates a Y post deck separated from a base
Figure 11B:
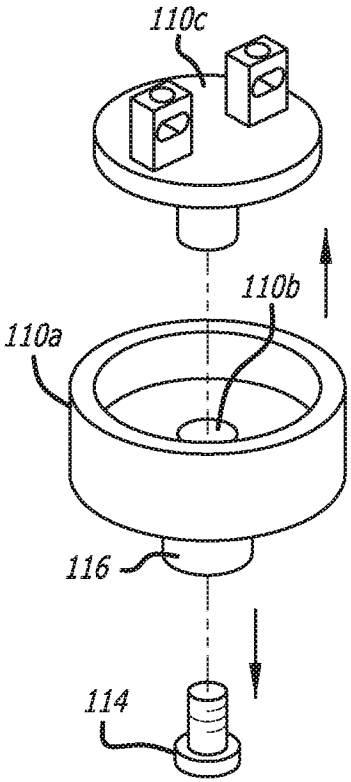
FIG. 11B illustrates a 2 post deck separated from a base.
Figure 11A:
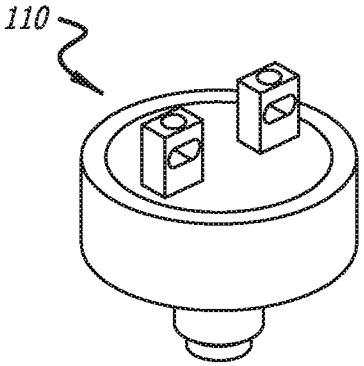
FIG. 11A illustrates a 2 post building deck.

According to one aspect, the user may change the building deck in the atomizer. As shown in FIGS. 11A, 11B, 11C and 11D, the building deck portion 110 of the inner air chamber 104 may include a base 110*a* adapted to receive a building deck. The building deck may be secured to the base 110*a* by pin 114 inserted through an opening 110*b* in the base 110*a* and a washer 116 may be utilized between the pin 114 and the base 110*a*. This allows user, for example, to swap out a 2 post deck 110*c* (see FIG. 11B) for a Y post deck 110*d* (see FIG. 11C) FIG. 11A illustrates a 2 post building deck while FIG. 11D illustrates a Y post building deck.

According to one example with a 2 post deck, the building deck 117 may include vertically extending posts 118, 120 configured for attaching coils 123 (See FIG. 2B). The coils 123 are secured to the extending posts 118, 120 by screws 125. When attaching the coils 123 to the ending posts, the coils extend above air flow holes 119, 121 directing air directly onto the coils. When air flows out of the air flows holes 119, 121 onto heated coils 123 the e-liquid in the inner air chamber 104 vaporizes and this vapor is inhaled by the user. As the air flows directly onto the coils 123 the flavor of the vapor is intensified. Also included on the building deck portion 110 are a pair of opposing dynamic bottom air flow channels 122. The dynamic bottom air flow channels 122 allow air to enter the inner air chamber 104 from the side.

The inner sleeve portion 112, mounted to the building deck portion 110, may have a generally circular configuration. The inner sleeve portion 112 may be comprised of a base 140 and a top 142 integrally connected to the base 140. When the inner air chamber 104 is mounted within the adjustable air flow sleeve 102, the top 142 of the inner air chamber 104 extends out from an inner edge surface 136 of the adjustable air flow sleeve 102 and is configured to receive the mouthpiece 108, as described in more detail below. The base 140 of the inner sleeve portion 112 may include one or more concave grooves 144 equally located around the outer surface of the inner sleeve portion 112 and extending the vertical length of the base 140. As shown in FIGS. 5, 6 and 8, alternating concave grooves 144 may include a side air flow channel 146 which may create a lock track 148 or passageway allowing air to flow and be directed into the atomizer, as described in more detail below.

The air flow entering the inner air chamber 104 may be controlled by the user with the adjustable air flow sleeve 102 which is mounted over the inner air chamber 104. As shown, the adjustable air flow sleeve 102 may be generally cylindrical in shape and have an outer surface 130 and an inner surface 132. Both the outer and inner surfaces 130, 132 may be smooth with the inner surface 132 having one or more protrusions or lock tabs 134 integrally connected to and extending perpendicularly outward from inner surface 130. The lock tabs 134 may extend in a horizontal plane and have a generally elongated shape comprising a top wall member 134*a* and an opposing bottom wall member 134*b* (not shown) integrally connected by an edge wall member 134*c*. A first side wall member 134*d* may extend downwardly in a concave manner from a first side end 134$c_1$ of the edge wall member 134*c* to first outer edges of the top and bottom wall members 134*a*, 134*b*. A second side wall member 134*e* may extend downwardly in a concave manner from a second side end 134$c_2$ of the edge wall member 134 to second outer edges of the top and bottom wall members 134*a*, 134*b*. As described in more detail below, the lock tabs 134 may be configured to move within a lock track 148.

When the adjustable air flow sleeve 102 is mounted over the inner air chamber 104, the lock tabs 134 are aligned with the concave grooves 144 of the inner sleeve portion 112 having the side air flow channels 146 so that the lock tabs 134 may be received within the side air flow channels 146. The lock tabs 134 may move vertically within the side air flow channels 146 forming the lock track 148 or passageway. Rotating or turning the adjustable air flow sleeve 102 allows the air flow to be directed into the atomizer, as described in more detail below.

The adjustable air flow sleeve 102 may further include an inner edge surface 136 located inside the adjustable air flow sleeve 102 below the second end 102*b*. The inner edge surface 136 may include one or more holes 138 located around the inner edge surface 136. According to one aspect, the inner edge surface 136 has a circular configuration. Although four (4) air holes 138 are shown equally spaced around the inner edge surface 136 in FIG. 3, this is by way of example only. The inner edge surface 136 may include less than four (4) air holes or more than four (4) air holes.

The pair of opposing dynamic bottom air flow channels 122 on the building deck portion 110 allow the air to be diverted onto the building deck from the side of the adjustable air flow sleeve 102. Once the adjustable air flow sleeve 102 is placed over the inner air chamber 104, air may only travel on the lock track 148 (or passageway) which allows the air to be diverted into the inner air chamber 104 and onto the coils 123 of the building deck allowing the user to obtain the best possible flavor when vaping. If air is not being diverted directly to the coils 123, the air provides no function and when a user is vaping without the diverting of the air, the user merely sucks a large amount of air instead of the vapor.

The adjustable air flow sleeve 102 may be adjusted in a clockwise or counter-clockwise direction providing for an adjustable dual intake option for the user. By rotating the adjust air flow sleeve in either the clockwise or counter-clockwise direction, the user can force the air flow in a particular direction diverting the air flow such the air flows into the inner air chamber just via the side air flow channels 146, the dynamic bottom air flow channels 122 or both the side air flow channels 146 and the dynamic bottom air flow channels 122. In other words, the adjustable air flow sleeve 102 creates the a lock track 148 or passageway allowing air to flow and be directed into the atomizer As the air entering the inner air chamber 104 comes from the lock track 148 and this air does not mix with air outside the atomizer. Alternatively, the user can turn or rotate the adjustable air flow sleeve 102 such that air is prevented from entering the atomizer.

According to one aspect, when the cap 106 is secured to the adjustable air flow sleeve 102 and the adjustable air flow sleeve 102 is not rotated, the air enters the building deck of the inner air chamber 104 from the side air flow channels 146 and from the dynamic airflow channels 122.

According to one aspect, turning the adjustable air flow sleeve 102 clockwise 60 degrees causes the adjustable air flow sleeve 102 to lock with the building deck portion 110 of the inner air chamber 104. As a result of rotating the adjustable air flow sleeve 102 in the clockwise direction, the lock tabs 134 on the inner surface of the adjustable air flow sleeve 102 are secured within the lock track 148 securing the inner sleeve portion 112 to the building deck portion 110. When in this position, only the side air flow channels 146 on the inner sleeve portion of the inner air chamber 104 are being used to divert air flow into the inner air chamber 104 and the dynamic bottom air flow channels 122 are sealed off. (See FIG. 5)

According to one aspect, turning the adjustable air flow sleeve 104 counter-clockwise by 60 degrees also causes the adjustable air flow sleeve 102 to lock with the building deck portion 110 of the inner air chamber 104. As a result of rotating the adjustable air flow sleeve 102 in the counter-clockwise direction, the lock tabs 134 on the inner surface of the adjustable air flow sleeve 102 are secured within the lock track 148 securing the inner sleeve portion 112 to the building deck portion 110. When in this position, all air flow is sealed off. (See FIG. 6) Once the air flow is sealed off, the user may continue twisting the adjustable air flow sleeve 102 (see FIG. 7) while pulling the adjustable air flow sleeve 102 upwards removing the adjustable air flow sleeve 102 and separating the building deck portion 110 and an inner sleeve portion 112.

In other words, when the cap 106 is secured to the adjustable air flow sleeve 102 and the adjustable air flow sleeve 102 is not rotated, the air gets into the building deck from the side air flow channels 146 and from the dynamic airflow channels 122. Turning the adjustable air flow sleeve 102 clockwise about 60 degrees causes the adjustable air flow sleeve to lock onto the atomizer and the lock tabs 134 to close or block up to approximately 90% of the dynamic bottom air flow channels 122 causing the atomizer to only receive air via the side air flow channels 146.

According to one aspect, the adjustable air flow sleeve 102 not only locks the inner air chamber 104 but allows the user to adjust the air flow by turning the adjustable air flow sleeve clockwise or counter-clockwise+/−60 degrees in either direction. When the adjustable air flow sleeve 102 is locked onto the inner air chamber 104 by the lock tabs 134, the inner air chamber 104 will not move. However, rotating the adjustable air flow sleeve 102 allows for the air intake holes 138 on the inner edge surface 136 of the adjustable air flow sleeve 102 to open and close which either allows or prevents air from entering the inner air chamber 104. The cap 106 includes a plurality of side openings allowing air to enter the top of the atomizer, but whether the air is able to enter the inner air chamber 104 depends on whether the air intake holes are open or closed. Prior art atomizers on the market just allow a sleeve of an atomizer to be turned to adjust air flow by rotating a ring on the bottom of the atomizer. As the ring is very small and little space is available for the user to grab onto the ring making it inconvenient.

The rebuildable dripping atomizer with adjustable air flow for use with an electronic cigarette of the present invention allows the advanced user to customizer the atomizer. When customizing the user first tightens the rebuildable dripping atomizer onto the energy source device. After tightening the atomizer, the user then turn and pulls the adjustable air flow sleeve 60 degrees counter-clockwise. Once the lock tabs on the inner surface of the adjustable air flow sleeve are positioned vertically with the lock path, the adjustable air flow sleeve may then be easily pull upwardly. Once the adjustable air flow sleeve has been removed, the user may then build the coils on the building deck portion of the inner air chamber and then place the inner sleeve portion of the inner air chamber onto the building deck portion or the inner air chamber in the same direction. When in this position, both the side air flow channels and the dynamic bottom air flow channels are being utilized to gain air intake. The user may then screw on the cap which causes the lock tabs to secure the position of the inner sleeve.

One or more of the components and functions illustrated in the may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

What is claimed is:

1. A rebuildable dripping atomizer for an electronic cigarette, comprising:

an inner air chamber, the inner air chamber comprising:

a building deck portion having one or more dynamic bottom air flow channels; and an inner sleeve portion mounted onto the building deck portion, the inner sleeve portion having at least two concave grooves extending a vertical length of the inner sleeve portion where at least one of the at least two concave grooves include a side air flow channel forming a passageway allowing air flow to be diverted;

an adjustable air flow sleeve mounted over the inner air chamber, the adjustable air flow sleeve comprising:

an outer surface; and an opposing inner surface, the inner surface having one or more protrusions integrally connected to and extending outwardly therefrom, the one or more protrusions moveable within the passageway; and wherein the adjustable air flow sleeve locks the inner air chamber and allows a user to adjust the air flow by turning the adjustable air flow sleeve clockwise or counter-clockwise for adjustable the air flow;

a removable cap adapted to be received on the adjustable air flow sleeve; and a removable mouthpiece secured to the removable cap.

2. The rebuildable dripping atomizer of claim 1, wherein the removable cap include a plurality of cut out portions on a side edge forming openings in the atomizer when the removable cap is secured to the adjustable air flow sleeve.

3. The rebuildable dripping atomizer of claim 1, further including an inner edge surface extending outwardly from the inner surface, the inner edge surface having one or more inner edge surface holes configured to allow air into the inner air chamber from outside the atomizer.

4. The rebuildable dripping atomizer of claim 1, wherein the inner edge surface has a circular configuration and the one or more inner edge surface holes are equally spaced around the inner edge surface.

5. The rebuildable dripping atomizer of claim 1, wherein the inner sleeve portion of the inner air chamber extends outwardly from the inner edge surface.

6. The rebuildable dripping atomizer of claim 1, where each of the one or more protrusions comprises:

a top wall member extending in a first vertical plane;

a bottom wall member extending in a second vertical plane, where the first vertical plane is different than the second vertical plane;

an edge wall member integrally connecting the top wall member and the bottom wall member;

a first side wall member extending downwardly in a concave manner from a first side end of the edge wall member to first outer edges of the top and bottom wall members; and a second side wall member extending downwardly in a concave manner from a second side end of the edge wall member to second outer edges of the top and bottom wall members.

7. The rebuildable dripping atomizer of claim 1, where the adjustable air flow sleeve is rotatable in a clockwise direction locking the adjustable air flow sleeve to the building deck portion of the inner air chamber and locking the protrusions in the passageway securing the inner sleeve portion to the building deck portion.

8. The rebuildable dripping atomizer of claim 7, wherein the adjustable air flow sleeve is rotatable in the clockwise direction 60 degrees.

9. The rebuildable dripping atomizer of claim 1, wherein the adjustable air flow sleeve rotates in a counter-clockwise direction locking the adjustable air flow sleeve to the building deck portion of the inner air chamber and locking the protrusions in the passageway securing the inner sleeve portion to the building deck portion.

10. The rebuildable dripping atomizer of claim 7, wherein the adjustable air flow sleeve is rotatable in the counter-clockwise direction 60 degrees.

11. The rebuildable dripping atomizer of claim 1, wherein the adjustable air flow sleeve rotates independently of the inner air chamber.

12. The rebuildable dripping atomizer of claim 1, wherein rotating the adjustable air flow sleeve around the inner sleeve portion of the inner air chamber causes the one or more inner edge surface holes on the inner edge surface of the adjustable air flow sleeve to open and close allowing and preventing air from entering the atomizer.

13. The rebuildable dripping atomizer of claim 1, wherein the side air flow channel on the inner sleeve portion of the inner air chamber have an elongated configuration located in a vertical plane.

14. The rebuildable dripping atomizer of claim 1, wherein the dynamic bottom air flow channels on the building deck portion of the inner air chamber have an elongated configuration located in a vertical plane.

15. The rebuildable dripping atomizer of claim 1, wherein the mouthpiece comprises:

an upper end portion;

a lower end portion configured to be received within an opening of the removable cap, the lower end portion having a plurality of spit back openings located around a bottom side surface of the lower end portion; and a middle stop portion integrally connected between the upper end portion and the lower end portion.

16. The rebuildable dripping atomizer of claim 15, wherein the detachable mouthpiece has a circular configuration wherein a diameter of the middle stop portion is larger than a diameter of the opening in the cap.

17. The rebuildable dripping atomizer of claim 16, wherein the upper end portion includes an upper lip having a diameter equal to the diameter of the middle stop portion; and wherein an outer surface of the mouthpiece between the upper lip and the middle stop portion has a diameter smaller than the diameter of the upper lip and the diameter of the middle stop portion.

* * * * *